United States Patent [19]

Oliver

[11] 4,327,512

[45] May 4, 1982

[54] IDENTIFICATION DEVICE

[76] Inventor: Robert L. Oliver, 3570 Cartwright St., Pasadena, Calif. 91107

[21] Appl. No.: 215,525

[22] Filed: Dec. 11, 1980

[51] Int. Cl.[3] ..... A44C 3/00; G09F 3/18; B65D 85/02; B65D 6/12

[52] U.S. Cl. ..... 40/2 E; 206/806; 206/303; 40/10 D; 220/8

[58] Field of Search ..... 40/1.5, 2 E, 10 D, 2 A, 40/10 R, 2 R, 323, 27.5, 5, 6; 63/1 A, 18; 428/13, 14; 206/485, 486, 0.8, 0.81, 0.82, 0.83, 0.84, 303, 416, 806; 132/73, 83 R; 220/8, 306

[56] References Cited

U.S. PATENT DOCUMENTS

| | | | |
|---|---|---|---|
| 1,475,652 | 11/1923 | Polizzi | 40/27.5 |
| 2,095,869 | 10/1937 | Hermson | 40/2 E |
| 2,511,651 | 6/1950 | Schlitz | 40/2 A |
| 3,407,523 | 10/1968 | Winston | 40/1.5 |
| 3,819,847 | 6/1974 | Charles | 206/303 |
| 4,058,216 | 11/1977 | Tsuyuguchi | 206/416 |
| 4,217,724 | 8/1980 | Schoenfield et al. | 46/22 |
| 4,254,566 | 3/1981 | Haskell | 40/2 E |

FOREIGN PATENT DOCUMENTS

| | | | |
|---|---|---|---|
| 1511150 | 9/1978 | Fed. Rep. of Germany | 40/323 |

*Primary Examiner*—Robert Peshock
*Assistant Examiner*—Michael J. Foycik
*Attorney, Agent, or Firm*—Phillips, Moore, Weissenberger, Lempio & Majestic

[57] ABSTRACT

A container to be attached to a shoestring or the like and adapted to contain information regarding the medical condition and/or identification of the wearer. The container is made of two halves formed from a resilient plastic material, which define between them a cavity in which a specially-shaped piece of paper with the necessary information can be placed.

10 Claims, 6 Drawing Figures

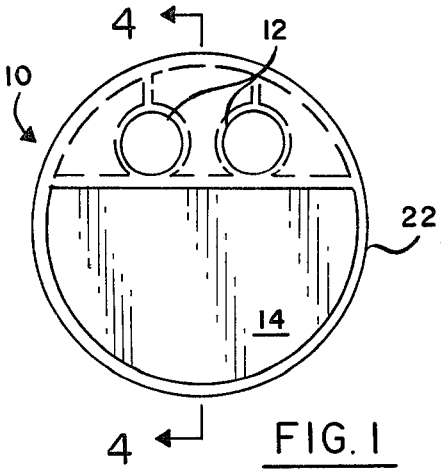
FIG. 1
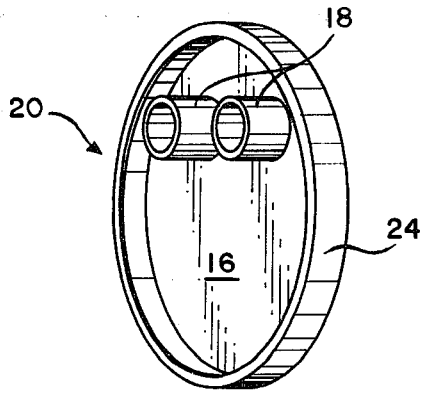
FIG. 2
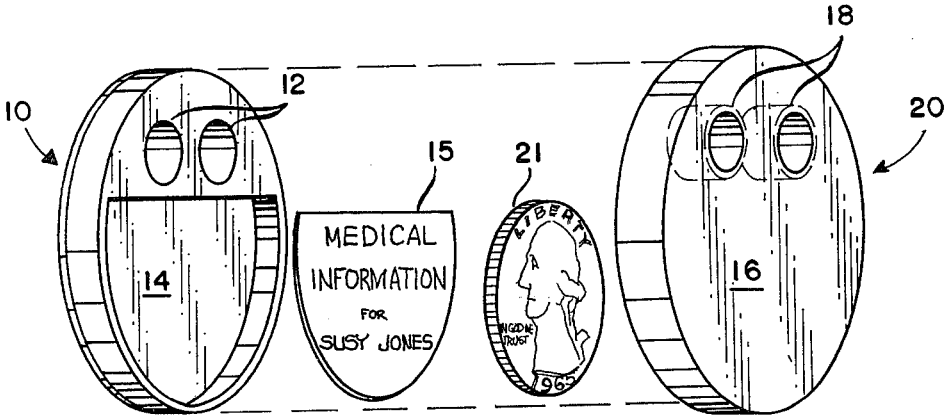
FIG. 3
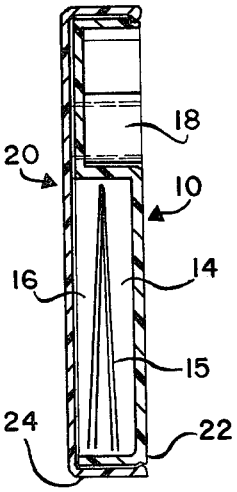
FIG. 4
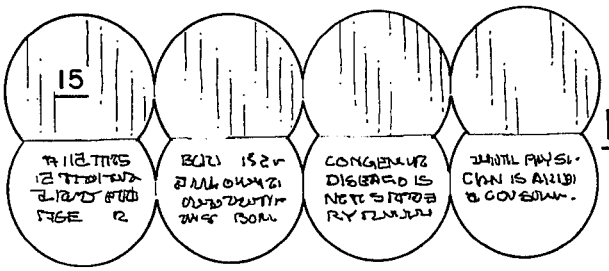
FIG. 5
FIG. 6
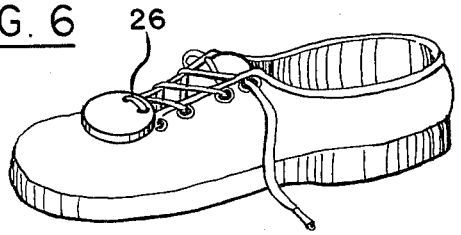

IDENTIFICATION DEVICE

BACKGROUND OF THE INVENTION

My invention relates to an identification device with protected identification means that is specially adapted for attachment to a shoestring or the like.

Conventional lockets, tags, pendants, pins and the like have been in use for some time. A typical identification device suitable for attachment to a necklace or the like is shown in U.S. Pat. No. 3,407,523 to Winston. Winston's device is not, however, suitable to be affixed to a shoe because it would flip-flop when the wearer is in motion, and its ear is not sufficient to hold a shoe lace. Attachment to a shoe is very desirable in the case of children or joggers, who otherwise carry no identification on their person. Moreover, the Winston identification device has a limited inscription space.

SUMMARY OF THE INVENTION

My invention is an identification device specially adapted for shoes, particularly children's shoes, because it lies flat on top of the shoe. Furthermore, it has hollow cylindrical passages which are an integral part of the device, thus making it difficult for children to open the device when it is laced onto the shoe. Moreover, the transparency of the case makes the presence of the information-carrying paper readily detectable. The device is also designed to be water-resistant, and to provide a virtually unlimited area for the recording of information.

BRIEF DESCRIPTION OF THE DRAWINGS

FIG. 1 is a plan view of the case portion of the identification device used in the preferred embodiment of the invention.

FIG. 2 is a perspective view of the cover portion of the device.

FIG. 3 is an exploded view of the device illustrating the information-carrying paper placed between the case and cover portions.

FIG. 4 is a cross-sectional view taken along 4—4 of FIG. 1 with the cover portion attached.

FIG. 5 illustrates a piece of paper specifically shaped for use with the device of this invention and adapted to receive identification or other information.

FIG. 6 is a perspective view showing the identification device laced to the shoe of the wearer.

DESCRIPTION OF THE PREFERRED EMBODIMENT

FIG. 1 shows the case 10 of the device which has a pair of openings 12 and a cavity 14 formed therein. The case 10 is preferably made of polyethylene or some other resilient plastic material. It is preferred that the case 10 be transparent so that the presence of the information-carrying paper may be readily detected. In addition, the case 10 has a lip 22 around its perimeter to provide an interlock with cover portion 20 of FIG. 2 for purposes hereinafter described.

The cover 20 of the device carries a pair of hollow cylindrical projections 18 which fit the pair of openings 12. The outer surface of the cylindrical projections 18 engages the inner surface of the openings 12 when the two halves are pressed together, thus forming a waterproof press fit which holds the two halves together. Moreover, cover lip 24 engages case lip 22 to form a waterproof seal around the outside perimeter of the device. Cavity 14 and the overlying portion of the surface 16 thus form the compartment for carrying the information-carrying paper 15. The inner surfaces of the projections 18 form a pair of conduits through the body of the device, when closed, which allow a shoestring or other attachment means to be threaded through them. The cover 20 is preferably opaque while the case 10 is transparent, so that, for privacy, the presence of the information-carrying paper may be detected only if the device is lifted up from the surface against which it normally lies and is turned over.

FIG. 5 shows the shape of a paper 15 specially cut to fit into the cavity when properly folded. The paper 15 is first fan-folded and then folded in half about a horizontal axis. The type of information contained on the paper 15 is wholly discretionary with the wearer. It may typically be information regarding the medical condition and/or identification of the wearer. Such information as name, address, telephone number, school address, employment address, blood type, diabetic condition, heart condition, allergies, etc. may be useful.

For emergencies, it is desirable to hold the information carrying paper 15 in a position where it can be readily read. The clipped-disc shape of the paper 15 when folded, as shown in FIG. 3, readily cooperates with the shape of the cavity 14 to prevent rotation of the paper 15.

It may be desirable to make the cavity 14 of such size that a coin such as a quarter 21 may be placed into the cavity 14 and held firmly therein by a press fit. In that case, the fact that the coin 21 would have to have a smaller radius than the radius of the cavity 14 will allow the information-carrying paper 15 to be seen even if it is partially obscured by the coin 21.

FIG. 3 is an exploded view illustrating the position and shape of the paper 15 prior to closing the case, and FIG. 4 is a cross-sectional view of the device, when fully closed, taken along line 4—4 of FIG. 1. Lips 22 and 24 are shaped so as to engage each other to snap tightly closed and form a water-resistant seal. In order to open the case, diametrically opposed edges of case 10 must be pinched with the thumb and forefinger to pop the elastic cover off. The resiliency of the plastic tends to close the device after it has been opened. As illustrated in FIG. 6, the device is preferably worn at the lower end of the shoestrings on top of the shoe. The bridge 26 formed by the device and the shoelace holds the device flat against the shoe.

I claim:

1. An identification device, comprising:

(a) a case member having a body, a cavity formed in said body, a pair of generally cylindrical apertures extending through said body and upstanding rim means along the periphery of said cavity; and (b) a cover member having a pair of hollow, generally cylindrical projections open at each end extending therefrom, said projections being adapted to mate with said apertures of said case member throughout a substantial portion of their length; said cover member having about its periphery, means arranged to engage said rim means ;

(c) said cover and case members cooperating, when said projections are mated with said apertures and said rimengaging means are engaged with said rim means, to define an enclosure adapted to receive and enclose an indicia-carrying object.

2. The identification device of claim 1 wherein said apertures and projections are generally cylindrical.

3. The identification device of claim 1, wherein said apertures receive said projections in a press-fit relationship when said cover and case are assembled together.

4. The identification device of claim 1 wherein said rim-engaging means include upstanding lip means about the periphery of said cover member, said lip means being arranged to lockingly engage said rim means.

5. The identification device of claim 1 wherein said case member and said cover member are formed of a flexible material.

6. The identification device of claim 1 wherein said case member is transparent and said cover member is opaque.

7. The identification device of claim 1 wherein said case member and said cover member are circular-shaped.

8. The identification device of claim 5 wherein said cavity is of an appropriate size and shape to receive information-carrying means therein in a non-rotatable position.

9. The identification device of claim 8 further comprising information-carrying means which, when fan-folded and folded in half, assumes the shape of a clipped disc cooperating with said cavity to prevent relative rotation.

10. The identification device of claim 1, wherein the inner diameter of said cylindrical projections is on the order of the thickness of a shoe lace.

* * * * *